United States Patent [19]

Katsuno

[11] Patent Number: 4,720,973

[45] Date of Patent: Jan. 26, 1988

[54] DOUBLE AIR-FUEL RATIO SENSOR SYSTEM HAVING DOUBLE-SKIP FUNCTION

[75] Inventor: Toshiyasu Katsuno, Susono, Japan

[73] Assignee: Toyota Jidosha Kabushiki Kaisha, Aichi, Japan

[21] Appl. No.: 830,866

[22] Filed: Feb. 19, 1986

[30] Foreign Application Priority Data

Feb. 23, 1985 [JP] Japan ..... 60-33671

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,163,433 | 8/1979 | Fujishiro | 123/440 |
| 4,235,204 | 11/1980 | Rice | 123/440 |
| 4,251,989 | 2/1981 | Norimatsu et al. | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,603,670 | 8/1986 | Bertsch et al. | 123/440 |

FOREIGN PATENT DOCUMENTS

| | | | |
|---|---|---|---|
| 52-102934 | 8/1977 | Japan . | |
| 53-103796 | 9/1978 | Japan . | |
| 55-37562 | 3/1980 | Japan . | |
| 57-76241 | 5/1982 | Japan | 123/489 |
| 57-32772 | 7/1982 | Japan . | |
| 57-32773 | 7/1982 | Japan . | |
| 57-32774 | 7/1982 | Japan . | |
| 58-27848 | 2/1983 | Japan . | |
| 58-53661 | 3/1983 | Japan . | |
| 58-48755 | 3/1983 | Japan . | |
| 58-48756 | 3/1983 | Japan . | |
| 58-72646 | 4/1983 | Japan . | |
| 58-72647 | 4/1983 | Japan . | |
| 58-135343 | 8/1983 | Japan . | |
| 58-152147 | 9/1983 | Japan . | |
| 58-150038 | 9/1983 | Japan . | |
| 58-150039 | 9/1983 | Japan . | |
| 59-32644 | 2/1984 | Japan . | |
| 59-206638 | 11/1984 | Japan . | |
| 60-1340 | 1/1985 | Japan . | |
| 60-26138 | 2/1985 | Japan . | |
| 60-53635 | 3/1985 | Japan . | |
| 61-34330 | 2/1986 | Japan . | |
| 61-53436 | 3/1986 | Japan . | |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an air-fuel ratio correction amount is calculated in accordance with the output of the upstream-side air-fuel ratio sensor, and the actual air-fuel ratio is adjusted in accordance with the calculated air-fuel ratio correction amount and the output of the downstream-side air-fuel ratio sensor. When the output of the upstream-side air-fuel ratio sensor is switched from the rich side to the lean side, or vice versa, the air-fuel ratio correction amount is shifted remarkably by a first skip amount for a predetermined time period, and after this period, the air-fuel ratio correction amount is shifted conventionally by a second skip amount which is smaller than the first skip amount.

50 Claims, 38 Drawing Figures

Fig. 8A
Fig. 8
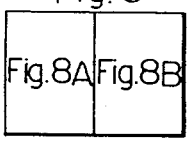
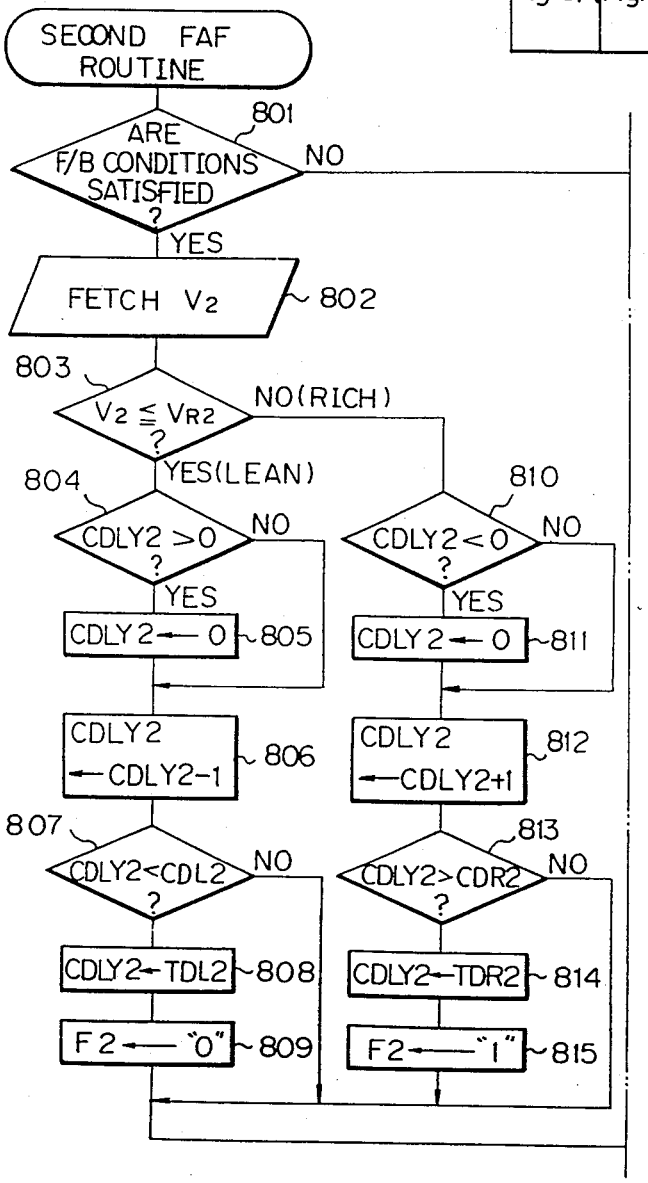

DOUBLE AIR-FUEL RATIO SENSOR SYSTEM HAVING DOUBLE-SKIP FUNCTION

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio in a single air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, when the response speed of the upstream-side $O_2$ sensor is reduced to reduce the control frequency thereof, the control frequency of the entire system of the double $O_2$ sensor system is also reduced, thereby deteriorating the accuracy of the controlled air-fuel ratio. Also, when differences in the air-fuel ratio are generated between the cylinders, and the upstream-side $O_2$ sensor is strongly affected by one of the cylinders, the switching of the output of the upstream-side $O_2$ sensor from the rich side to the lean side, or vice versa, becomes irregular, so that the determination for the output of the upstream-side $O_2$ sensor becomes unstable, thereby shifting the controlled air-fuel ratio to the rich side or to the lean side. For example, when the output of the upstream-side $O_2$ sensor is switched from the rich side to the lean side to increment fuel to be supplied to the engine, the controlled air-fuel ratio becomes rich. However, if differences in the air-fuel ratio are generated between the cylinders, the exhaust gas passing over the upstream-side $O_2$ sensor becomes lean or rich temporarily, and as a result, the upstream-side $O_2$ sensor generates a temporary lean signal (lean-spike signal) or a temporary rich signal (rich-spike signal), thereby fluctuating the controlled air-fuel ratio. Such fluctuation of the controlled air-fuel ratio due to the lean-spike or rich-spike signals of the upstream-side $O_2$ sensor cannot be compensated for by the air-fuel ratio feedback control of the downstream-side $O_2$ sensor, so that it is impossible to operate the catalyst converter (especially, the three way reducing and oxidizing catalyst converter) at an optimum condition, since the downstream-side $O_2$ sensor has low response speed characteristics.

SUMMARY OF THE INVENTION

It is an object of the present invention to provide a double air-fuel ratio sensor ($O_2$ sensor) system in which the response characteristics of the entire system are not deteriorated even when the response characteristics of the upstream-side $O_2$ sensor are deteriorated, and fluctuation of the controlled air-fuel ratio by the differences in the air-fuel ratio between the cylinders is avoided.

According to the present invention, in a double-air-fuel sensor system including two $O_2$ sensors upstream and downstream of a catalyst converter provided in an exhaust gas passage, an air-fuel ratio correction amount is calculated in accordance with the output of the upstream-side $O_2$ sensor, and the actual air-fuel ratio is adjusted in accordance with the calculated air-fuel ratio correction amount and the output of the downstream-side $O_2$ sensor. When the output of the upstream-side sensor is switched from the rich side to the lean side, or vice versa, the air-fuel ratio correction amount is shifted remarkably by a first skip amount for a predetermined time period, and after this period, the air-fuel ratio correction amount is shifted conventionally by a second skip amount which is smaller than the first skip amount.

Since the skip amount of the air-fuel ratio correction amount at the switching of the output of the upstream-side $O_2$ sensor is particularly large for the predetermined time period, that is, since a double skip operation is carried out, the frequency of the rich-to-lean or lean-to-rich switching of the output of the upstream-side $O_2$ sensor is increased. As a result, the response characteristics of the entire of the double $O_2$ sensor system are improved, and the shift of the controlled air-fuel ratio to the rich side or to the lean side is compensated for by feedback control of the downstream-side $O_2$ sensor.

BRIEF DESCRIPTION OF THE DRAWINGS

The present invention will be more clearly understood from the description as set forth below with reference to the accompanying drawings, wherein:

FIGS. 3, 3A,3B,3C, 5,5A,5B,5C, 6, 8,8A,8B and 9 are flow charts showing the operation of the control circuit of FIG. 2;

DESCRIPTION OF THE PREFERRED EMBODIMENTS

Figure 2:
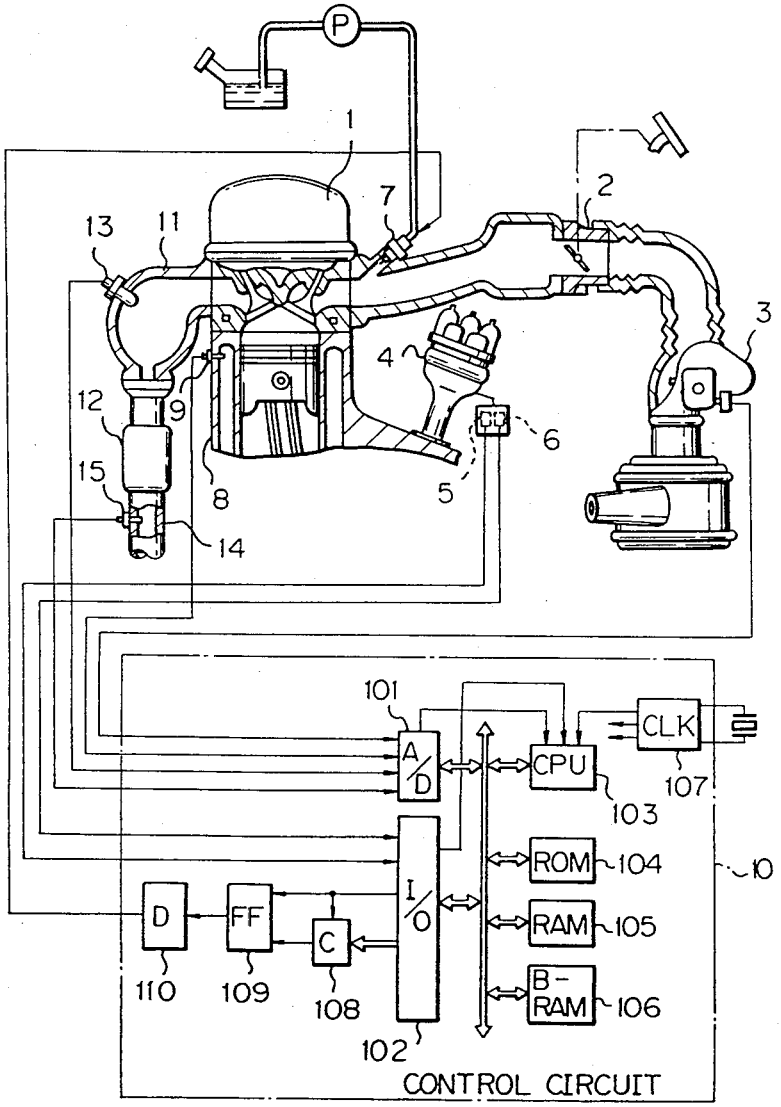
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1, to generate an analog voltage signal in proportion to the amount of air flowing therethrough. The signal from the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crank-shaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal thereof, to reset the flip-flop 109, so that the driver circuit 110 stops the activation of the fuel injection valve 14. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW are fetched by an A/D conversion routine(s) executed at every predetermined time period and are then stored in the RAM 105. That is, the data Q and THW in the RAM 105 are renewed at every predetermined time period. The engine speed NE is calculated by an interrupt routine executed at 30° CA, i.e., at every pulse signal of the crank angle sensor 6, and is then stored in the RAM 105.

The operation of the control circuit 10 of FIG. 2 will be explained with reference to the flow charts of FIGS. 3, 5, 6, 8, and 9.

Figure 3A:
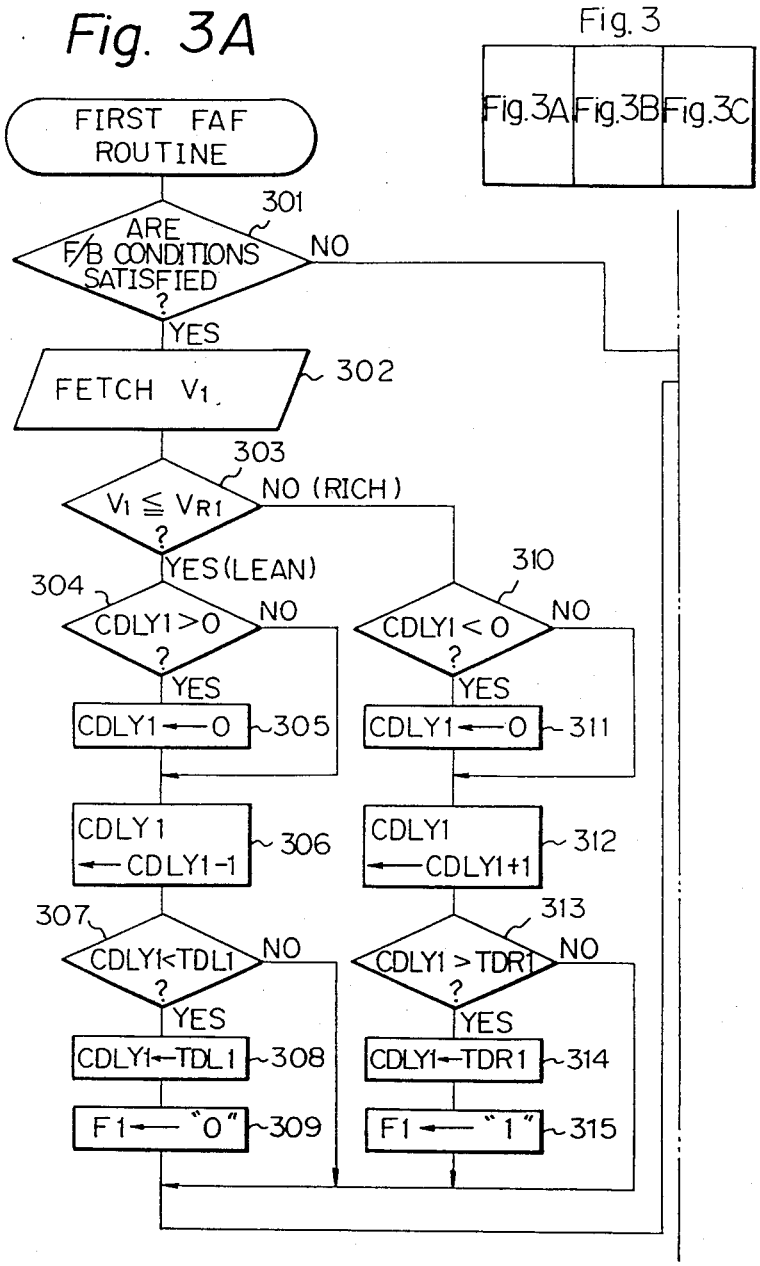
Figure 3B:
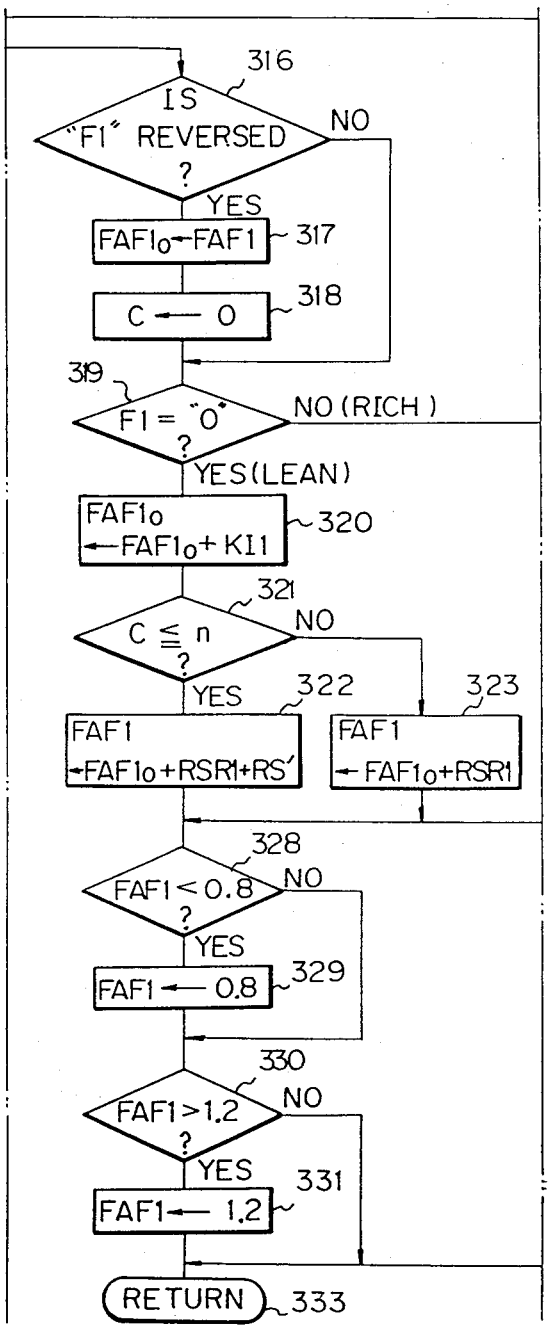
Figure 3C:
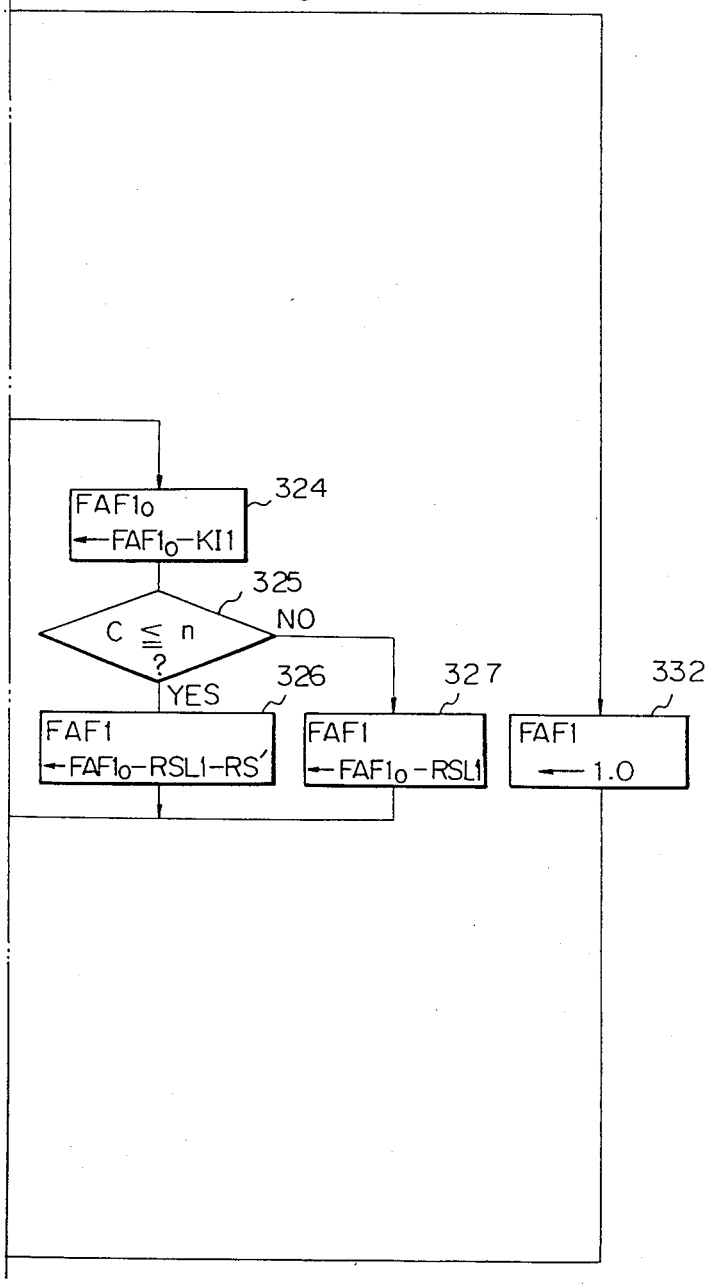

FIG. 3 is a routine for calculating a first air-fuel ratio feedback correction amount FAF1 in accordance with the output of the first $O_2$ sensor 13 executed at every predetermined time period such as 50 ms.

At step 301, it is determined whether or not all the feedback control (closed-loop control) conditions by the first $O_2$ sensor 13 are satisfied. The feedback control conditions are as follows:

(i) the engine is not in a starting state;
(ii) the coolant temperature THW is higher than 50° C.;
(iii) the power fuel increment FPOWER is 0; and
(iv) the first $O_2$ sensor 13 is not in an activated state. Note that the determination of activation/nonactivation of the first $O_2$ sensor 13 is carried out by determining whether or not the coolant temperature THW≧70° C., or by whether or not the output of the first $O_2$ sensor 13 is once swung. Of course, other feedback control conditions are introduced as occasion demands. However, an explanation of such other feedback control conditions is omitted.

If one or more of the feedback control conditions is not satisfied, the control proceeds to step 332, in which the amount FAF1 is caused to be 1.0 (FAF1=1.0), thereby carrying out an open-loop control operation. Note that, in this case, the correction amount FAF1 can be a learning value or a value immediately before the feedback control by the first $O_2$ sensor 13 is stopped.

Contrary to the above, at step 301, if all of the feedback control conditions are satisfied, the control proceeds to step 302.

At step 302, an A/D conversion is performed upon the output voltage $V_1$ of the first $O_2$ sensor 13, and the A/D converted value thereof is then fetched from the A/D converter 101. Then, at step 303, the voltage $V_1$ is compared with a reference voltage $V_{R1}$ such as 0.45 V, thereby determining whether the current air-fuel ratio detected by the first $O_2$ sensor 13 is on the rich side or on the lean side with respect to the stoichiometric air-fuel ratio.

If $V_1 = \leqq V_{R1}$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1≦0, the control proceeds directly to step 306. At step 306, the first delay counter CDLY1 is counted down by 1, and at step 307, it is determined whether or not CDLY1<TDL1. Note that TDL1 is a lean delay time period for which a rich state is maintained even after the output of the first $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0, the control proceeds to step 311, which clears the first delay counter CDLY1, and then proceeds to step 312. If CDLY1≧0, the control directly proceeds to 312. At step 312, the first delay counter CDLY1 is counted up by 1, and at step 313, it is determined whether or not CDLY1>TDR1. Note that TDR1 is a rich delay time period for which a lean state is maintained even after the output of the first $O_2$ sensor 13 is changed from the lean side to the rich side, and is defined by a positive value. Therefore, at step 313, only when CDLY1>TDR1 does the control proceed to step 314 which causes CDLY1 to be TDR1 and then to step 315, which causes the first air-fuel ratio flag F1 to be "1" (rich state).

At step 316, it is determined whether or not the first air-fuel ratio flag F1 is reversed, i.e., whether or not the delayed air-fuel ratio detected by the first $O_2$ sensor 13 is reversed. If the first air-fuel ratio flag F1 is reversed, the control proceeds to step 317, in which $$FAF1_0 \leftarrow FAF1.$$

That is, the parameter $FAF1_0$ is used in an integration process, and at step 317, the parameter $FAF1_0$ is coincided with the amount FAF1 immediately before the integration process. Then, at step 318, a counter C for determining a time period of a double skip operation is cleared.

Note that the counter C is counted up by +1 every time one fuel injection is carried out, as will be later explained. However, it is possible to count up the counter C at every predetermined time period.

At step 319, it is determined whether or not the air-fuel ratio flag F1 is "0". If F1="0", which means that the air-fuel ratio is lean, the control proceeds to step 320, which increases the parameter $FAF1_0$ by a relatively small amount KI1. Then, at step 321, it is determined whether or not the counter C reaches a predetermined value n, which is, for example, 5. If C≦n, then the control proceeds to step 322 in which $$FAF1 \leftarrow FAF1_0 + RSR1 + RS'.$$

That is, the correction amount FAF1 is increased from the parameter $FAF1_0$ by a skip amount RSR1+RS'. On the other hand, if C>n, at step 323, $$FAF1 \leftarrow FAF1_0 + RSR1.$$

That is, the correction amount FAF1 is increased from the parameter $FAF1_0$ by a skip amount RSR1. Note that RSR1 (RS')>KI1.

At step 319, if F1="1", which means the air-fuel ratio is rich, the control proceeds to step 324, which decreases the parameter $FAF1_0$ by the relatively small amount KI1. Then, at step 325, it is determined whether or not the counter C reaches the predetermined value n. If C≦n, then the control proceeds to step 326 in which $$FAF1 \leftarrow FAF1_0 - RSL1 - RS'.$$

That is, the correction amount FAF1 is decreased from the parameter $FAF1_0$ by a skip amount RSL1+RS'. On the other hand, if C>n, at step 327, $$FAF1 \leftarrow FAF1_0 - RSL1.$$

That is, the correction amount FAF1 is decreased from the parameter $FAF1_0$ by a skip amount RSL1. Note that RSL1 (RS')>KI1.

The correction amount FAF1 is guarded by a minimum value 0.8 at steps 328 and 329, and by a maximum value 1.2 at steps 330 and 331, thereby preventing the controlled air-fuel ratio from becoming overrich or overlean.

The correction amount FAF1 is then stored in the RAM 105, thus completing this routine at step 333.

Figures 4A, 4B, 4C, 4D:
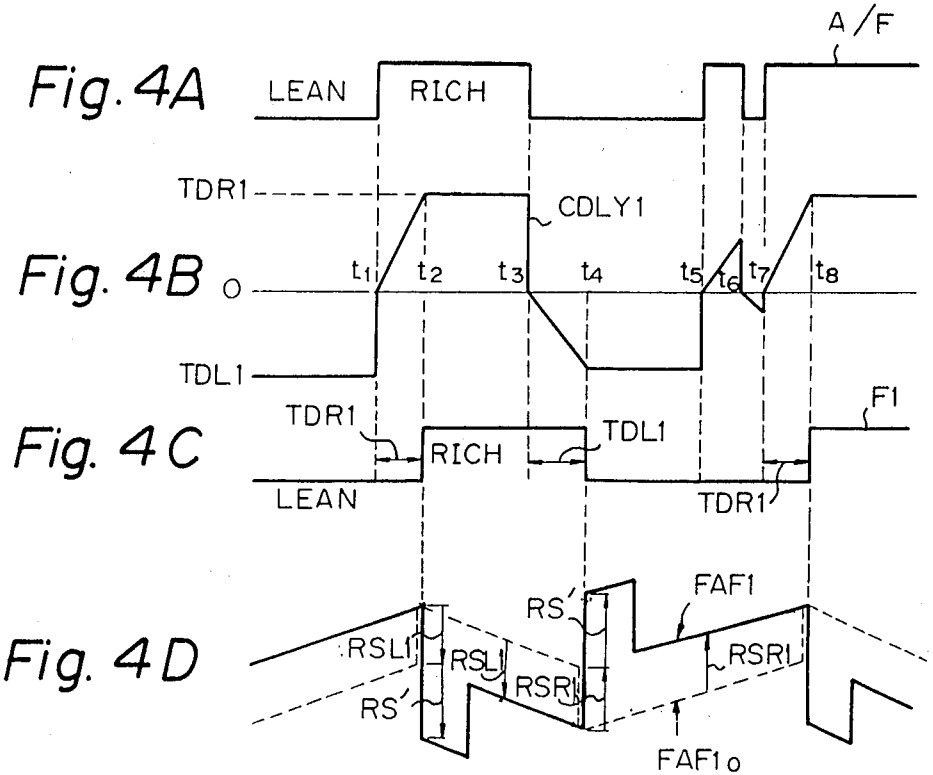
FIGS. 4A through 4D are timing diagrams explaining the flow chart of FIG. 3.

The operation by the flow chart of FIG. 3 will be further explained with reference to FIGS. 4A through 4D. As illustrated in FIG. 4A, when the air-fuel ratio A/F is obtained by the output of the first $O_2$ sensor 13, the first delay counter CDLY1 is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a shorter time period than the rich delay time period TDR1 or the lean delay time period TDL1, the delayed air-fuel ratio F1 is reversed at time $t_8$ That is, the delayed air-fuel ratio F1 is stable when compared with the air-fuel ratio A/F. Further, as illustrated in FIG. 4D, at every change of the delayed air-fuel ratio F1 from the rich side to the lean side, or vice versa, the correction amount FAF1 is shifted from the parameter $FAF1_0$ by the skip amount RSR1+RS' or RSL1+RS'. This shifting is maintained for the predetermined time period determined by the counter C. After that, the correction amount is shifted from the parameter $FAF1_0$ the skip amount RSR or RSL. Note that the parameter $FAF1_0$ is gradually increased or decreased in accordance with the delayed air-fuel ratio F1.

Air-fuel ratio feedback control operations by the second $O_2$ sensor 15 will be explained. There are two types of air-fuel ratio feedback control operations by the second $O_2$ sensor 15, i.e., the operation type in which a second air-fuel ratio correction amount FAF2 is introduced thereinto, and the operation type in which an air-fuel ratio feedback control constant in the air-fuel ratio feedback control operation by the first $O_2$ sensor 13 is variable. Further, as the air-fuel ratio feedback control constant, there are nominated a delay time period TD (in more detail, the rich delay time period TDR1 and the lean delay time period TDL1), a skip amount RS (in more detail, the rich skip amount RSR1 and the lean skip amount RSL1), and an integration amount KI (in more detail, the rich integration amount KIR1 and the lean integration amount KIK1).

For example, if the rich delay time period becomes larger than the lean delay time period (TDR1>TDL1), the controlled air-fuel ratio becomes richer, and if the lean delay time period becomes larger than the rich delay time period (TDL1>TDR1), the controlled air-fuel ratio becomes leaner. Thus the air-fuel ratio can be controlled by changing the rich delay time period TDR1 and the lean delay time period TDL1 in accordance with the output of the second $O_2$ sensor 15. Also, if the rich skip amount RSR1 is increased or if the lean skip amount RSL1 is decreased, the controlled air-fuel ratio becomes richer, and if the lean skip amount RSL1 is increased or if the rich skip amount RSR1 is decreased, the controlled air-fuel ratio becomes leaner. Thus, the air-fuel ratio can be controlled by changing the rich skip amount RSR1 and the lean skip amount RSL1 in accordance with the output of the second $O_2$ sensor 15. Further, if the rich integration amount KIR1 is increased or if the lean integration amount KIK1 is decreased, the controlled air-fuel ratio becomes richer, and if the lean integration amount KIK1 is increased or if the rich integration amount KIR1 is decreased, the controlled air-fuel ratio becomes leaner. Thus, the air-fuel ratio can be controlled by changing the rich integration amount KIR1 and the lean integration amount KIK1 in accordance with the output of the second $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the second $O_2$ sensor 15.

A double $O_2$ sensor system into which a second air-fuel ratio correction amount FAF2 is introduced will be explained with reference to FIGS. 5 and 6.

Figure 5A:
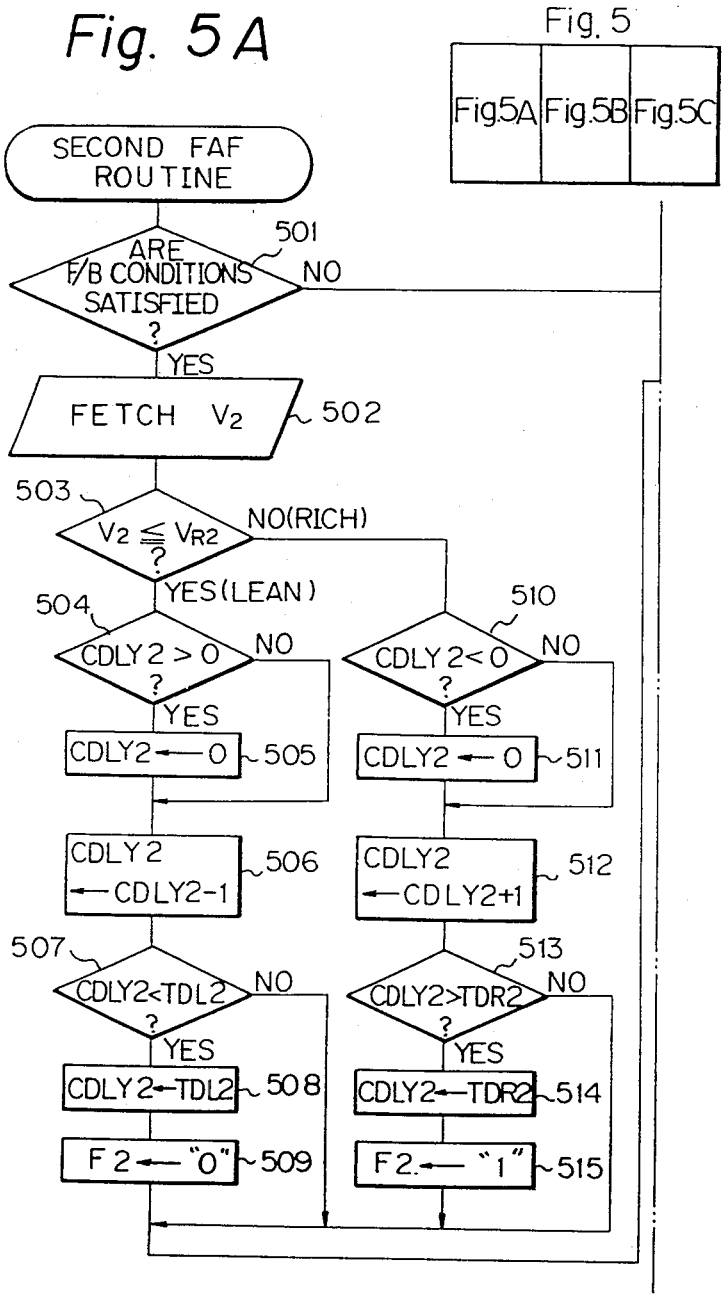
Figure 5B:
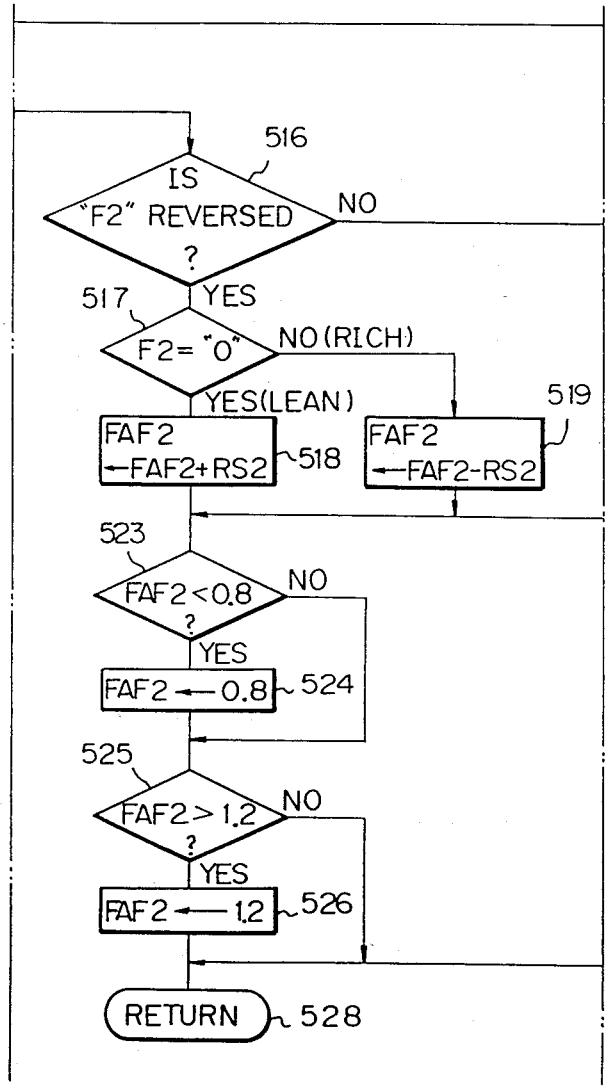
Figure 5C:
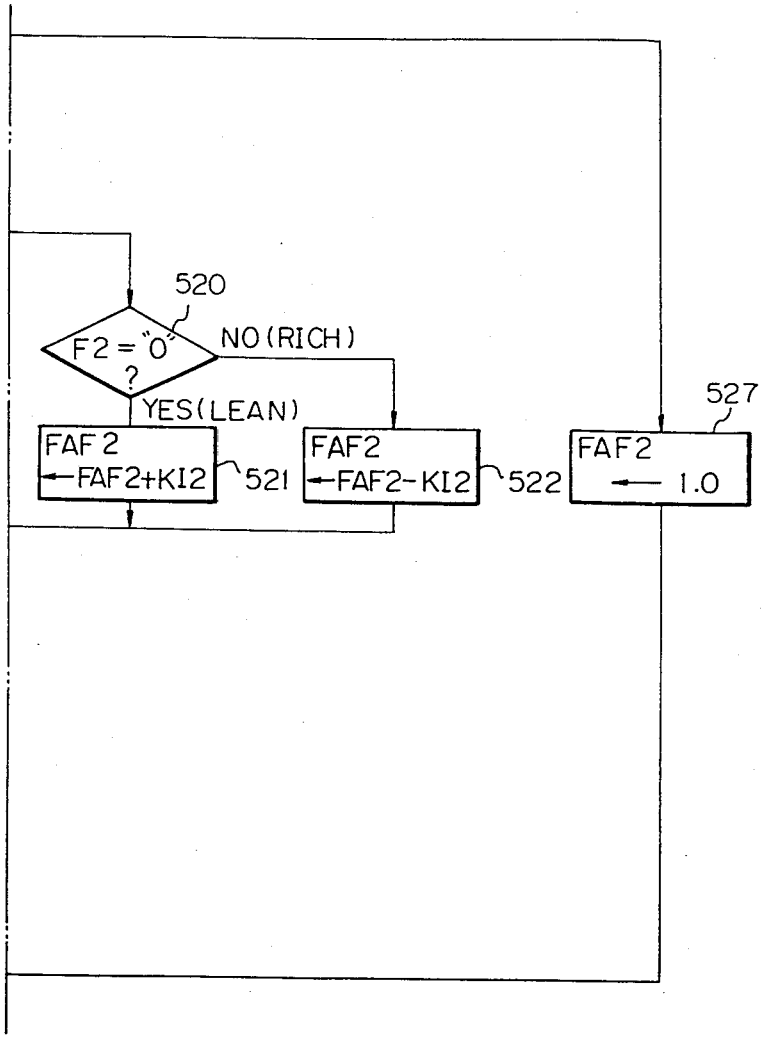

FIG. 5 is a routine for calculating a second air-fuel ratio feedback correction amount FAF2 in accordance with the output of the second $O_2$ sensor 15 executed at every predetermined time period such as 1 s.

At step 501, it is determined whether or not all the feedback control (closed-loop control) conditions by the second $O_2$ sensor 15 are satisfied. The feedback control conditions are as follows:

(i) the engine is not in a starting state;

(ii) the coolant temperature THW is higher than 50° C.;

(iii) the power fuel increment FPOWER is 0; and (iv) the second $O_2$ sensor 15 is not in an activated state. Note that the determination of activation/nonactivation of the second $O_2$ sensor 15 is carried out by determining whether or not the coolant temperature THW≧70° C., or by whether or not the output of the second $O_2$ sensor 15 is once swung. Of course, other feedback control conditions are introduced as occasion demands. However, an explanation of such other feedback control conditions is omitted.

If one or more of the feedback control conditions is not satisfied, the control proceeds to step 527, in which the correction amount FAF2 is caused to be 1.0 (FAF2=1.0), thereby carrying out an open-loop control operation. Note that, also in this case, the correction amount FAF2 can be a learning value or a value immediately before the feedback control by the second $O_2$ sensor 15 is stopped.

Contrary to the above, at step 501, if all of the feedback control conditions are satisfied, the control proceeds to step 502.

At step 502, an A/D conversion is performed upon the output voltage $V_2$ of the second $O_2$ sensor 15, and the A/D converted value thereof is then fetched from the A/D converter 101. Then, at step 503, the voltage $V_2$ is compared with a reference voltage $V_{R2}$ such as 0.55 V, thereby determining whether the current air-fuel ratio detected by the second $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the first $O_2$ sensor 13 upstream of the catalyst converter 12 and the second $O_2$ sensor 15 downstream of the catalyst converter 12.

Steps 504 through 515 correspond to steps 304 through 315, respectively, thereby performing a delay operation upon the determination at step 503. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, a second air-fuel ratio flag F2 is caused to be "0".

Next, at step 516, it is determined whether or not the second air-fuel ratio flag F2 is reversed, i.e., whether or not the delayed air-fuel ratio detected by the second $O_2$ sensor 15 is reversed. If the second air-fuel ratio flag F2 is reversed, the control proceeds to steps 517 to 519 which carry out a skip operation. That is, if the flag F2 is "0" (lean) at step 517, the control proceeds to step 518, which remarkably increases the second correction amount FAF2 by a skip amount RS2. Also, if the flag F2 is "1" (rich) at step 517, the control proceeds to step 519, which remarkably decreases the second correction amount FAF2 by the skip amount RS2. On the other hand, if the second air-fuel ratio flag F2 is not reversed at step 516, the control proceeds to steps 520 to 522, which carries out an integration operation. That is, if the flag F2 is "0" (lean) at step 520, the control proceeds to step 521, which gradually increases the second correction amount FAF2 by an integration amount KI2. Also, if the flag F2 is "1" (rich) at step 520, the control proceeds to step 522, which gradually decreases the second correction amount FAF2 by the integration amount KI2.

The second correction amount FAF2 is guarded by a minimum value 0.8 at steps 523 and 524, and by a maximum value 1.2 at steps 525 and 526, thereby also preventing the controlled air-fuel ratio from becoming overrich or overlean.

The correction amount FAF2 is then stored in the RAM 105, thus completing this routine of FIG. 5 at step 528.

Figure 6:
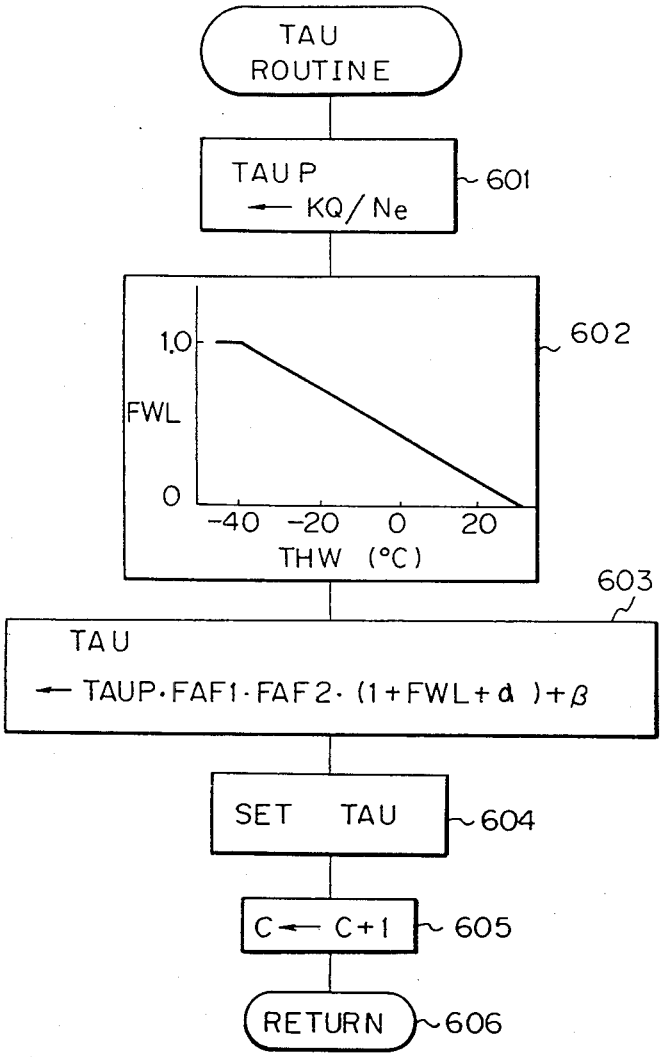

FIG. 6 is a routine for calculating a fuel injection amount TAU executed at every predetermined crank angle such as 360° CA. At step 601, a base fuel injection amount TAUP is calculated by using the intake air amount data Q and the engine speed data Ne stored in the RAM 105. That is, $$TAUP \leftarrow KQ/Ne$$

where K is a constant. Then at step 602, a warming-up incremental amount FWL is calculated from a one-dimensional map by using the coolant temperature data THW stored in the RAM 105. Note that the warming-up incremental amount FWL decreases when the coolant temperature THW increases. At step 603, a final fuel injection amount TAU is calculated by $$TAU \leftarrow TAUP \cdot FAF1 \cdot FAF2 \cdot (1+FWL+\alpha)+\beta$$

where $\alpha$ and $\beta$ are correction factors determined by other parameters such as the voltage of the battery and the temperature of the intake air. At step 604, the final fuel injection amount TAU is set in the down counter 108, and in addition, the flip-flop 109 is set to initiate the activation of the fuel injection valve 7. At step 605, the counter C is counted up by 1. As explained above, the counter C is used at steps 321 and 325 of FIG. 3. Then, this routine is completed by step 606. Note that, as explained above, when a time period corresponding to the amount TAU passes, the flip-flop 109 is reset by the carry-out signal of the down counter 108 to stop the activation of the fuel injection valve 7.

Figures 7A, 7B, 7C, 7D, 7E:
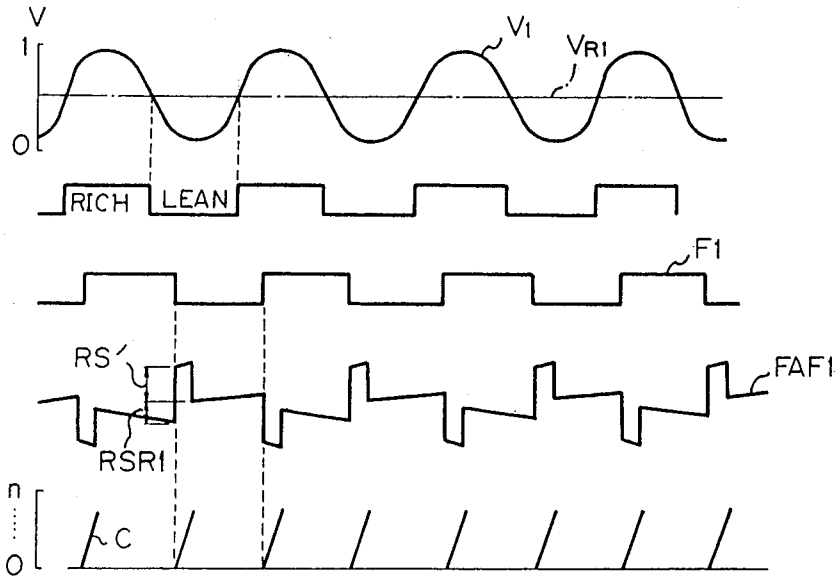
FIGS. 7A through 7I are timing diagrams explaining the flow charts of FIGS. 3, 5, and 6.
Figures 7F, 7G, 7H, 7I:
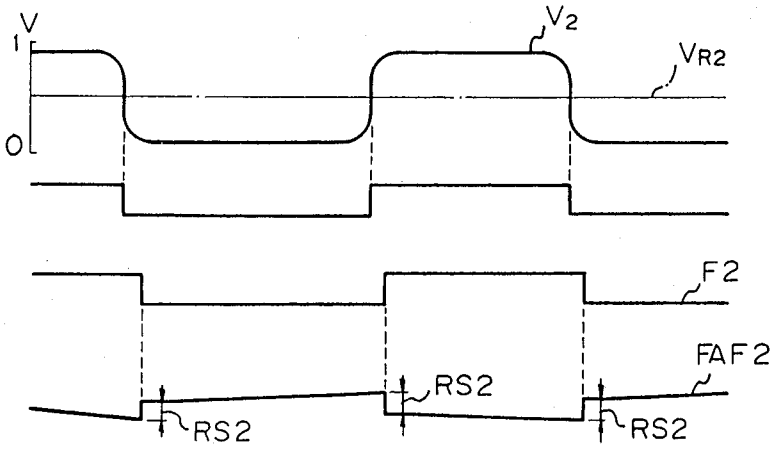

FIGS. 7A through 7I are timing diagrams for explaining the two air-fuel ratio correction amounts FAF1 and FAF2 obtained by the flow charts of FIGS. 3, 5, and 6. When the output of the first $O_2$ sensor 13 is changed as illustrated in FIG. 7A, the determination at step 303 of FIG. 3 is shown in FIG. 7B, and a delayed determination thereof corresponding to the first air-fuel ratio flag F1 is shown in FIG. 7C. As a result, as shown in FIG. 7D, every time the delayed determination is changed from the rich side to the lean side, or vice versa, the first air-fuel ratio correction amount FAF1 is shifted by the skip amount RSR1+RS' or RSL1+RS'. This state is maintained until the number C of injections reaches n, as shown in FIG. 7E. After that, the first air-fuel ratio correction amount FAF1 is shifted by the skip amount RSR1 or RSL1. That is, first a large amount of skip is carried out, and then a small amount of skip is carried out. On the other hand, when the output of the second $O_2$ sensor 15 is changed as illustrated in FIG. 7F, the determination at step 503 of FIG. 5 is shown in FIG. 7G, and the delayed determination thereof corresponding to the second air-fuel ratio flag F2 is shown in FIG. 7H. As a result, as shown in FIG. 7I, every time the delayed determination is changed from the rich side to the lean side, or vice versa, the second air-fuel ratio correction amount FAF2 is shifted by the skip amount RSR2.

A double $O_2$ sensor system, in which an air-fuel ratio feedback control constant of the first air-fuel ratio feedback control by the first $O_2$ sensor is variable, will be explained with reference to FIGS. 8 and 9. In this case, the skip amounts RSR1 and RSL1 as the air-fuel ratio feedback control constants are variable.

Figure 8B:
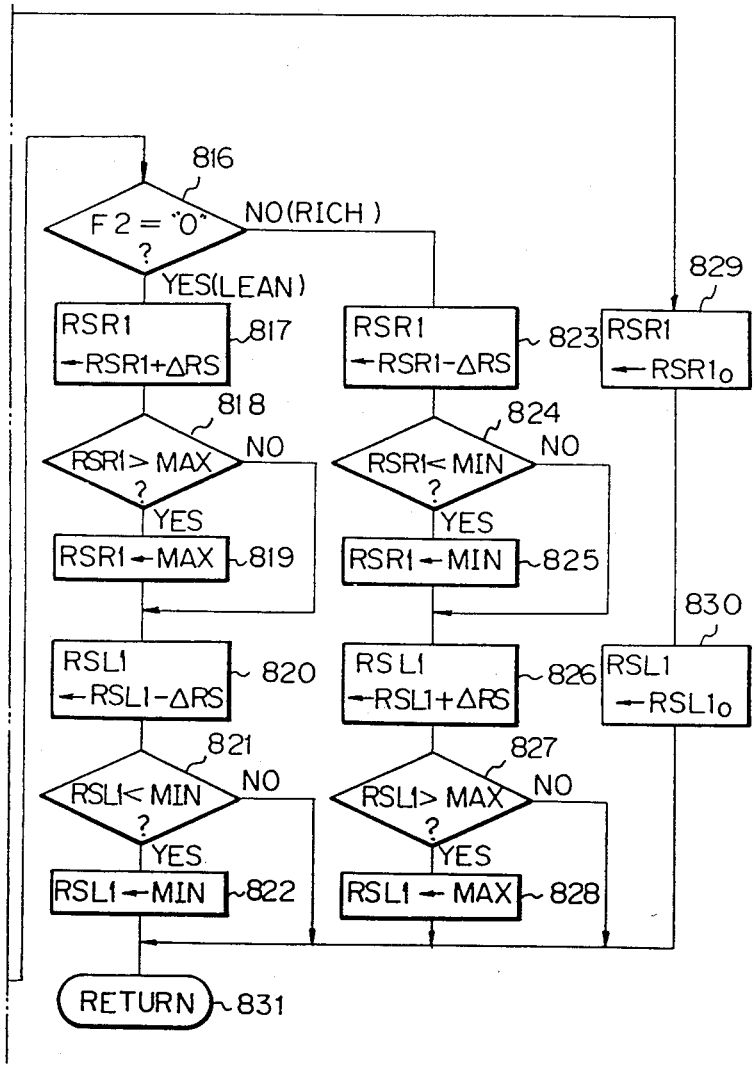

FIG. 8 is a routine for calculating the skip amounts RSR1 and RSL1 in accordance with the output of the second $O_2$ sensor 15 executed at every predetermined time period such as 1 s.

Steps 801 through 815 are the same as steps 501 through 515 of FIG. 5. That is, if one or more of the feedback control conditions is not satisfied, the control proceeds to steps 829 and 830, thereby carrying out an open-loop control operation. For example, the rich skip amount RSR1 and the lean skip amount RSL1 are made definite values $RSR_0$ and $RSL_0$ which are, for example, 5%. Note that, in this case, the skip amounts RSR1 and RSL1 can be learning values or values immediately before the feedback control by the second $O_2$ sensor 15 is stopped.

Contrary to the above, if all of the feedback control conditions are satisfied, the second air-fuel ratio flag F2 is determined by the routine of steps 803 through 815.

At step 816, it is determined whether or not the second air-fuel ratio F2 is "0". If F2="0", which means that the air-fuel ratio is lean, the control proceeds to steps 817 through 822, and if F2="1", which means that the air-fuel ratio is rich, the control proceeds to steps 823 through 828.

At step 817, the rich skip amount RSR1 is increased by a definite value ΔRS which is, for example, 0.08, to move the air-fuel ratio to the rich side. At steps 818 and 819, the rich skip amount RSR1 is guarded by a maximum value MAX which is, for example, 6.2%. Further, at step 820, the lean skip amount RSL1 is decreased by the definite value ΔRS to move the air-fuel ratio to the lean side. At steps 821 and 822, the lean skip amount RSL1 is guarded by a minimum value MIN which is, for example, 2.5%.

On the other hand, at step 823, the rich skip amount RSR1 is decreased by the definite value ΔRS to move the air-fuel ratio to the lean side. At steps 824 and 825, the rich skip amount RSR1 is guarded by the minimum value MIN. Further, at step 826, the lean skip amount RSL1 is decreased by the definite value ΔRS to move the air-fuel ratio to the rich side. At steps 827 and 828, the lean skip amount RSL1 is guarded by the maximum value MAX.

The skip amounts RSR1 and RSL1 are then stored in the RAM 105, thereby completing this routine of FIG. 8 at step 528.

Thus, according to the routine of FIG. 8, when the delayed output of the second $O_2$ sensor 15 is lean, the rich skip amount RSR1 is gradually increased, and the lean skip amount RSL1 is gradually decreased, thereby moving the air-fuel ratio to the rich side. Contrary to this, when the delayed output of the second $O_2$ sensor 15 is rich, the rich skip amount RSR1 is gradually decreased, and the lean skip amount RSL1 is gradually increased, thereby moving the air-fuel ratio to the lean side.

Figure 9:
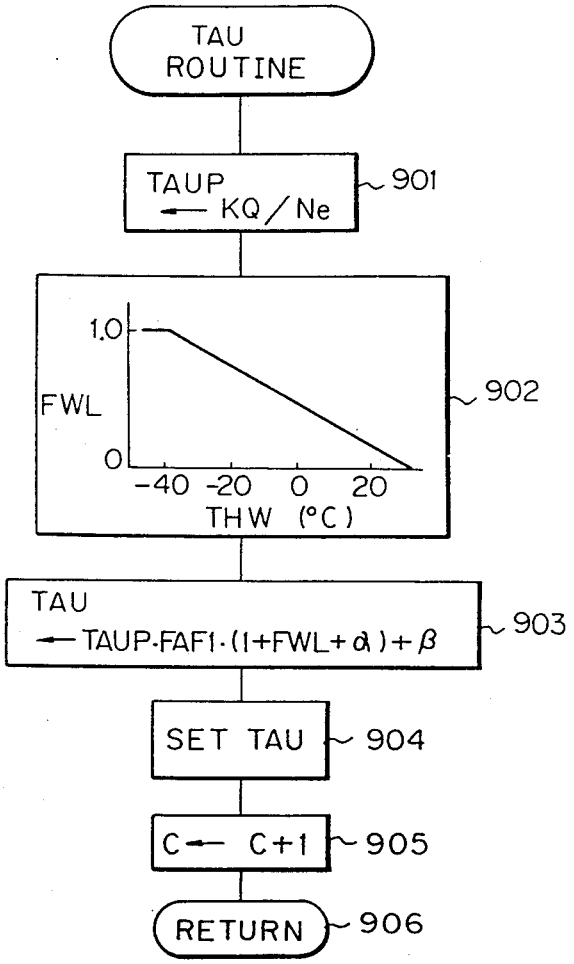

FIG. 9 is a routine for calculating a fuel injection amount TAU executed at every predetermined crank angle such as 360° CA. At step 901, a base fuel injection amount TAUP is calculated by using the intake air amount data Q and the engine speed data Ne stored in the RAM 105. That is, $$TAUP \leftarrow KQ/Ne$$

where K is a constant. Then at step 902, a warming-up incremental amount FWL is calculated from a one-dimensional map by using the coolant temperature data THW stored in the RAM 105. Note that the warming-up incremental amount FWL decreases when the coolant temperature THW increases. At step 903, a final fuel injection amount TAU is calculated by $$TAU \leftarrow TAUP \cdot FAF1 \cdot (1+FWL+\alpha)+\gamma$$

where $\alpha$ and $\gamma$ are correction factors determined by other parameters such as the voltage of the battery and the temperature of the intake air. At step 904, the final fuel injection amount TAU is set in the down counter 108, and in addition, the flip-flop 109 is set to initiate the activation of the fuel injection valve 7. At step 905, the counter C is counted up by 1. As explained above, the counter C is used at steps 321 and 325 of FIG. 3. Then, this routine is completed by step 906. Note that, as explained above, when a time period corresponding to the amount TAU has passed, the flip-flop 109 is reset by the carry-out signal of the down counter 108 to stop the activation of the fuel injection valve 7.

Figures 10A, 10B, 10C, 10D, 10E:
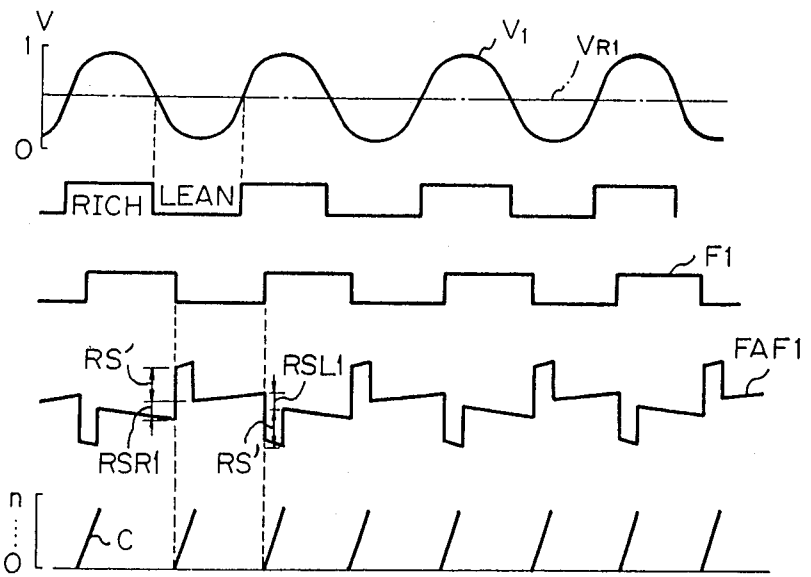
FIGS. 10A through 10J are timing diagrams explaining the flow charts of FIGS. 3, 8, and 9.
Figures 10F, 10G, 10H, 10I, 10J:
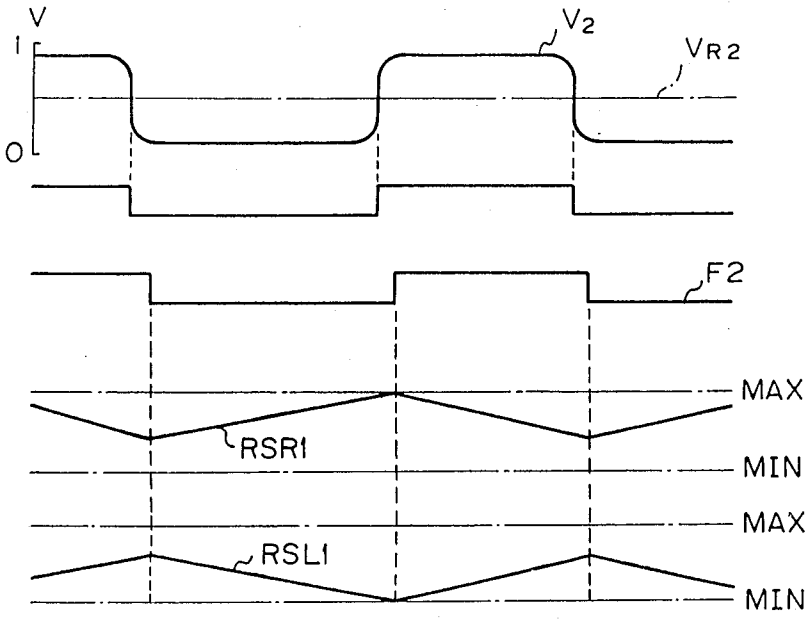

FIGS. 10A through 10J are timing diagrams for explaining the air-fuel ratio correction amount FAF1 and the skip amounts RSR1 and RSL1 obtained by the flow charts of FIGS. 3, 8, and 9. FIGS. 10A through 10H are the same as FIGS. 7A through 7H, respectively. As shown in FIGS. 10H, 10I, and 10J, when the delayed determination F2 is lean, the rich skip amount RSR1 is increased and the lean skip amount RSL1 is decreased, and when the delayed determination F2 is rich, the rich skip amount RSR1 is decreased and the lean skip amount RSL1 is increased. In this case, the skip amounts RSR1 and RSL1 are changed within a range from MAX to MIN.

Note that the calculated parameters FAF1 and FAF2, or FAF1, RSR1, and RSL1 can be stored in the backup RAM 106, thereby improving drivability at the re-starting of the engine.

Also, the first air-fuel ratio feedback control by the first $O_2$ sensor 13 is carried out at every relatively small time period, such as 4 ms, and the second air-fuel ratio feedback control by the second $O_2$ sensor 15 is carried out at every relatively large time period, such as 1 s. This is because the first $O_2$ sensor 13 has good response characteristics when compared with the second $O_2$ sensor 15.

Further, the present invention can be applied to a double $O_2$ sensor system in which other air-fuel ratio feedback control constants, such as the delay time periods TDR1 and TDL1, the integration amount KI1, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 601 of FIG. 6 or at step 901 of FIG. 9 is determined by the carburetor itself, i.e., the intake air negative pressure and the engine speed, and the air amount corresopnding to TAU at step 603 of FIG. 6 or at step 903 of FIG. 9.

Further, a CO sensor, a lean-mixture sensor or the like can be also used instead of the $O_2$ sensor.

Figure 1:
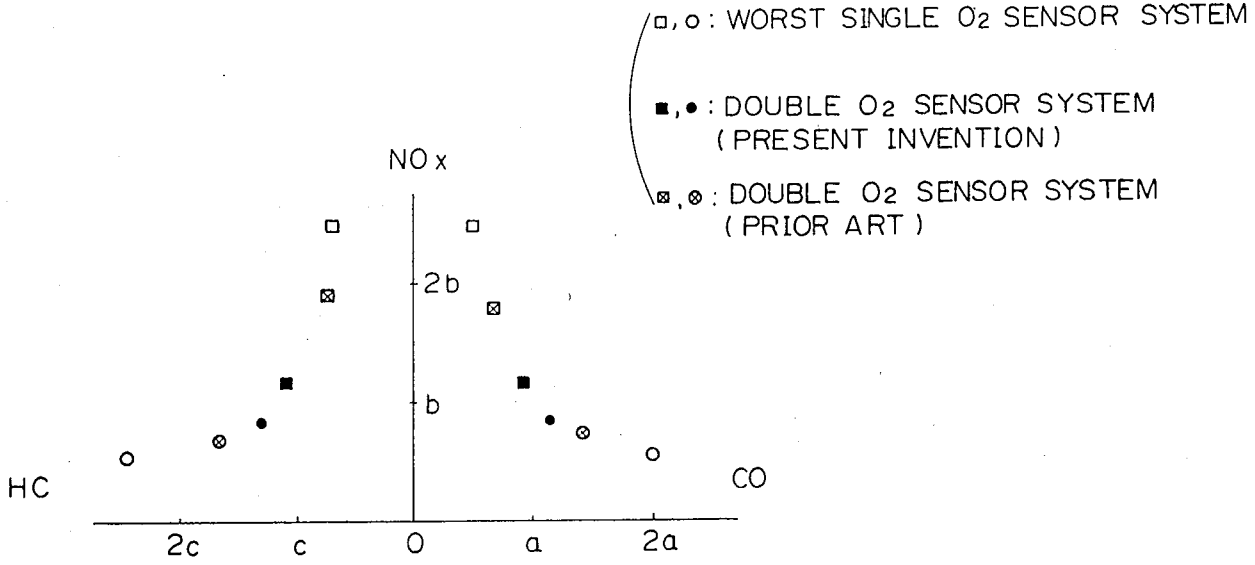
FIG. 1 is a graph showing the emission characteristics of a single $O_2$ sensor system and a double $O_2$ sensor system.

As explained above, according to the present invention, even when the response characteristics of the first air-fuel ratio sensor upstream of the catalyst converter are deteriorated, the response characteristics of the entire system are not deteriorated and fluctuation of the controlled air-fuel ratio by the differences inthe air-fuel ratio between the cylinders is avoided, thus obtaining the proper emission characteristics as illustrated in FIG. 1, since a double skip operation is used.

I claim:

1. A method for controlling the air-fuel ratio in an internal combustion engine having a catalyst converter for removing pollutants in the exhaust gas thereof, and upstream-side and downstream-side air-fuel ratio sensors disposed upstream and downstram, respectively, of said catalyst converter for detecting a cncentration of a specific component in an exhaust gas, comprising the steps of:

comparing the output of said upstream-side air-fuel ratio sensor with a first predetermined value;

gradually changing a first air-fuel ratio correction amount in accordance with a result of the comparison of the output of said upstream-side air-fuel ratio sensor with said predetermined value;

shifting said first air-fuel ratio correction amount by a first skip amount during a predetermined time period after the result of the comparison of said upstream-side air-fuel ratio sensor is changed;

shifting said first air-fuel ratio correction amount by a second skip amount smaller than said first skip amount after said predetermined time period has passed;

comparing the output of said downstream-side air-fuel ratio with a second predetermined value;

calculating a second air-fuel ratio correction amount in accordance with the comparison result of the output of said downstream-side air-fuel ratio sensor with said second predetermined value; and adjusting the actual air-fuel ratio in accordance with said first and second air-fuel ratio correction amounts;

wherein said gradually-changing step comprises the steps of:

gradually decreasing said first air-fuel ratio correction amount when the output of said upstream-side air-fuel sensor is on the rich side with respect to said first predetermined value; and gradually increasing said first air-fuel ratio correction amount when the output of said upstream-side air-fuel sensor is on the lean side with respect to said first predetermined value; and wherein said step of shifting by said first skip amount comprises the steps of:

shifting down said first air-fuel ratio correction amount by said first skip amount for said predetermined time period after the result of the comparison of said upstream-side air-fuel ratio sensor is switched from the lean side to the rich side; and shifting up said first air-fuel ratio correction amount by said first skip amount for said predetermined time period after the result of the comparison of said upstream-side air-fuel ratio sensor is switched from the rich side to the lean side; and wherein said step of shifting by said second skip amount comprises the steps of:

shifting up said first air-fuel ratio correction amount by said second skip amount after said predetermined time period has passed after the result of the comparison of said upstream-side air-fuel ratio sensor is switched from the lean side to the rich side; and shifting down said first air-fuel ratio correction amount by said second skip amount after said predetermined time period has passed after the result of the comparison of said upstream-side air-fuel ratio sensor is switched from the rich side to the lean side.

2. A method as set forth in claim 1 wherein said first skip amount during said shafting down step is different from said first skip amount during said shifting up step.

3. A method as set forth in claim 1, wherein said second skip amount during said shifting down step is different from said second skip amount during said shifting up step.

4. A method as set forth in claim 1, wherein said predetermined time period is determined by the speed of said engine.

5. A method as set forth in claim 1, wherein said second air-fuel correction amount calculating step comprises the steps of:

gradually decreasing said second air-fuel ratio correction amount when the output of said downstream-side air-fuel ratio sensor is on the rich side with respect to said second predetermined value;

gradually increasing said second air-fuel ratio correction amount when the output of said downstream-side air-fuel ratio sensor is on the lean side with respect to said second predetermined value;

remarkably decreasing said second air-fuel ratio correction amount when the output of said downstream-side air-fuel ratio sensor is switched from the lean side to the rich side; and remarkably increasing said second air-fuel ratio correction amount when the output of said downstream-side air-fuel ratio sensor is switched from the rich side to the lean side.

6. A method as set forth in claim 1, further comprising a step of delaying the result of the comparison of said upstream-side air-fuel ratio sensor with said first predetermined value.

7. A method as set forth in claim 1, further comprising a step of delaying the result of the comparison of said downstream-side air-fuel ratio sensor with said second predetermined value.

8. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first predetermined value;

gradually changing an air-fuel ratio correction amount in accordance with the comparison result of the output of said upstream-side air-fuel ratio sensor with said predetermined value;

shifting said air-fuel ratio correction amount by a first skip amount during a predetermined time period after the result of the comparison of said upstream-side air-fuel ratio sensor is changed;

shifting said air-fuel ratio correction amount by a second skip amount smaller than said first skip amount after said predetermined time period has passed;

comparing the output of said downstream-side air-fuel ratio with a second predetermined value;

calculating an air-fuel ratio feedback control parameter in accordance with the result of the comparison of the output of said downstream-side air-fuel ratio sensor with said second predetermined value; and adjusting the actual air-fuel ratio in accordance with said air-fuel ratio correction amount and said air-fuel ratio feedback control parameter;

wherein said gradually-changing step comprises the steps of:

gradually decreasing said air-fuel ratio correction amount when the output of said upstream-side air-fuel sensor is on the rich side with respect to said first predetermined value; and gradually increasing said air-fuel ratio correction amount when the output of said upstream-side air-fuel sensor is on the lean side with respect to said first predetermined value;

wherein said step of shifting by said first skip amount comprises the steps of:

shifting down said air-fuel ratio correction amount by said first skip amount for said predetermined time period after the result of the comparson of said upstream-side air-fuel ratio sensor is switched from the lean side to the rich side; and shifting up said air-fuel ratio correction amount by said first skip amount for said predetermined time period after the result of the comparison of said upstream-side air-fuel ratio sensor is switched from the rich side to the lean side; and wherein said skipping step by said second skip amount comprises the steps of:

shifting up said air-fuel ratio correction amount by asid second skip amount after said predetermined time period has passed after the result of the comparison of said upstream-side air-fuel ratio sensor is switched from the lean side to the rich side; and shifting down said air-fuel ratio correction amount by said second skip amount after said predetermined time period has passed after the result of the comparison of said upstream-side air-fuel ratio sensor is switched from the rich side to the lean side.

9. A method as set forth in claim 8, wherein said second skip amount during said shifting down step is different from said skip amount during said shifting up step.

10. A method as set forth in claim 8, wherein said predetermined time period is determined by the speed of said engine.

11. A method as set forth in claim 8, wherein said air-fuel ratio feedback control parameter is determined by a rich delay time period for delaying the result of the comparison of said upstream-side air-fuel ratio sensor switched from the lean side to the rich side and a lean delay time period for delaying the result of the comparison of said upstream-side air-fuel ratio sensor switched from the rich side to the lean side.

12. A method as set forth in claim 11, wherein said air-fuel ratio feedback control parameter calculating step comprises the steps of:

increasing said lean delay time period when the output of said downstream-side air-fuel ratio sensor is on the rich side with respect to said second predetermined value; and decreasing said lean delay time period when the output of said downstream-side air-fuel ratio sensor is on the lean side with respect to said second predetermined value.

13. A method as set forth in claim 11, wherein said air-fuel ratio feedback control parameter calculating step comprises the steps of:

decreasing said rich delay time period when the output of said downstream-side air-fuel ratio sensor is on the rich side with respect to said second predetermined value; and increasing said rich delay time period when the output of said downstream-side air-fuel ratio sensor is on the lean side with respect to said second predetermined value.

14. A method as set forth in claim 11, wherein said air-fuel ratio feedback control parameter calculating step comprises the steps of:

increasing said lean delay time period and decreasing said rich delay time period when the output of said downstream-side air-fuel ratio sensor is on the rich side with respect to said second predetermined value; and decreasing said lean delay time period and increasing said rich delay time period when the output of said downstream-side air-fuel ratio sensor is on the lean side with respect to said second predetermined value.

15. A method as set forth in claim 8, wherein said air-fuel ratio feedback control parameter is determined by said first skip amount (lean skip amount) during said shifting-down step and said first skip amount (rich skip amount) during said shifting-up step.

16. A method as set forth in claim 15, wherein said air-fuel ratio feedback control parameter calculating step comprises the steps of:

increasing said first skip amount (lean skip amount) during said shifting-down step when the output of said downstream-side air-fuel ratio sensor is on the rich side with respect to said second predetermined value; and decreasing said first skip amount (lean skip amount) during said shifting-down step when the output of said downstream-side air-fuel ratio sensor is on the lean side with respect to said second predetermined value.

17. A method as set forth in claim 15, wherein said air-fuel ratio feedback control parameter calculating step comprises the steps of:

decreasing said first skip amount (rich skip amount) during said shifting-up step when the output of said downstream-side air-fuel ratio sensor is on the rich side with respect to said second predetermined value; and increasing said first skip amount (rich skip amount) during said shifting-up step when the output of said downstream-side air-fuel ratio sensor is on the lean side with respect to said second predetermined value.

18. A method as set forth in claim 15, wherein said air-fuel ratio feedback control parameter calculating step comprises the steps of:

increasing said first skip amount (lean skip amount) during said shifting-down step and decreasing said first skip amount (rich skip amount) during said shifting-up step when the output of said downstream-side air-fuel ratio sensor is on the rich side with respect to said second predetermined value; and decreasing said first skip amount (lean skip amount) during said shifting-down step and increasing said first skip amount (rich skip amount) during said shifting-up step when the output of said downstream-side air-fuel ratio sensor is on the lean side with respect to said second predetermined value.

19. A method as set forth in claim 8, wherein said air-fuel ratio feedback control parameter is determined by the decreasing speed of said gradually-decreasing step and the increasing speed of said gradually-increasing step.

20. A method as set forth in claim 19, wherein said air-fuel ratio feedback control parameter calculating step comprises the steps of:

increasing the decreasing speed of said gradually-decreasing step when the output of said downstream-side air-fuel ratio sensor is on the rich side with respect to said first predetermined value; and decreasing the decreasing speed of said gradually-decreasing step when the output of said downstream-side air-fuel ratio sensor is on the lean side with respect to said second predetermined value.

21. A method as set forth in claim 19, wherein said air-fuel ratio feedback control parameter calculating step comprises the steps of:

decreasing the increasing speed of said gradually-increasing step when the output of said downstream-side air-fuel ratio sensor is on the rich side with respect to said second predetermined value; and increasing the increasing speed of said gradually-increasing step when the output of said downstream-side air-fuel ratio sensor is on the lean side with respect to said second predetermined value.

22. A method as set forth in claim 19, wherein said air-fuel ratio feedback control parameter calculating step comprises the steps of:

increasing the decreasing speed of said gradually-decreasing step and decreasing the increasing speed of said gradually-increasing step when the output of said downstream-side air-fuel ratio sensor is on the rich side with respect to said second predetermined value; and decreasing the decreasing speed of said gradually-decreasing step and increasing the increasing speed of said gradually-increasing step when the output of said downstream-side air-fuel ratio sensor is on the lean side with respect to said second predetermined value.

23. A method as set forth in claim 8, wherein said air-fuel ratio feedback control parameter is determined by said first predetermined value.

24. A method as set forth in claim 23, wherein said air-fuel ratio feedback control parameter calculating setp comprises the steps of:

decreasing said first predetermined value, where said air-fuel ratio sensors are $O_2$ sensors, when the output of said downstream-side air-fuel ratio sensor is on the rich side with respect to said second predetermined value; and increasing said first predetermined value, where said air-fuel ratio sensors are $O_2$ sensors, when the output of said downstream-side air-fuel ratio sensor is on the lean side with respect to said second predetermined value.

25. A method as set forth in claim 8, further comprising a step of delaying the result of the comparison of said downstream-side air-fuel ratio sensor with said second predetermined value.

26. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising:

means for comparing the output of said upstream-side air-fuel ratio sensor with a first predetermined value;

means for gradually changing a first air-fuel ratio correction amount in accordance with the comparison result of the ouput of said upstream-side air-fuel ratio sensor with said predetermined value;

means for shifting said first air-fuel ratio correction amount by a first skip amount during a predetermined time period after the comparison result of said upstream-side air-fuel ratio sensor is changed;

means for shifting said first air-fuel ratio correction amount by a second skip amount smaller than said first skip amount after said predetermined time period has passed;

means for comparing the output of said downstream-side air-fuel ratio with a second predetermined value;

means for calculating a second air-fuel ratio correction amount in accordance with the result of the comparison of the output of said downstream-side air-fuel ratio sensor with said second predetermined value; and means for adjusting the actual air-fuel ratio in accordance with said first and second air-fuel rato correction amounts;

wherein said gradually-changing means comprises:

means for gradually decreasing said first air-fuel ratio correction amount when the output of sid upstream-side air-fuel sensor is on the rich side with respect to said first predetermined value;

means for gradually increasing said first air-fuel ratio correction amount when the output of said upstream-side air-fuel sensor is on the lean side with respect to said first predetermined value;

wherein said shifting means by said first skip amount comprises:

means for shifting down said first air-fuel ratio correction amount by said first skip amount for said predetermined time period after the result of the comparison of said upstream-side air-fuel ratio sensor is switched from the lean side to the rich side; and means for shifting up said first air-fuel ratio correction amount by said first skip amount for said predetermined time period after the result of the comparison of said upstream-side air-fuel ratio sensor is switched from the rich side to the lean side; and wherein said shifting step by said second skip amount comprises:

means for shifting up said first air-fuel ratio correction amount by said second second skip amount after said predetermined time period has passed after the result of the comparison of said upstream-side air-fuel ratio sensor is switched from the lean side to the rich side; and means for shifting down said first air-fuel ratio correction amount by said second skip amount after said predetermined time period has passed after the result of the comparison of said upstream-side air-fuel ratio sensor is switched from the rich side to the lean side.

27. An apparatus as set forth in claim 26 wherein said first skip amount during said shifting down means is different from said first skip amount during said shifting up means.

28. An apparatus as set forth in claim 26, wherein said second skip amount during said shifting down means is different from said second skip amount during said shifting up means.

29. An apparatus as set forth in claim 26, wherein said predetermined time period is determined by the speed of said engine.

30. An apparatus as set forth in claim 26, wherein said second air-fuel correction amount calculating means comprises:

means for gradually decreasing said second air-fuel ratio correction amount when the output of said downstream-side air-fuel ratio sensor is on the rich side with respect to said second predetermined value;

means for gradually increasing said second air-fuel ratio correction amount when the output of said downstream-side air-fuel ratio sensor is on the lean side with respect to said second predetermined value;

means for remarkably decreasing said second air-fuel ratio correction amount when the output of said downstream-side air-fuel ratio sensor is switched from the lean side to the rich side; and means for remarkably increasing said second air-fuel ratio correction amount when the output of said downstream-side air-fuel ratio sensor is switched from the rich side to the lean side.

31. An apparatus as set forth in claim 26, further comprising means for delaying the result of the comparison of said upstream-side air-fuel ratio sensor with said first predetermined value.

32. An apparatus as set forth in claim 26, further comprising a step of delaying the result of the comparison of said downstream-side air-fuel ratio sensor with said second predetermined value.

33. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising:

means for comparing the output of said upstream-side air-fuel ratio sensor with a first predetermined value;

means for gradually changing an air-fuel ratio correction amount in accordance with the result of the comparison of the output of said upstream-side air-fuel ratio sensor with said predetermined value;

means for shifting said air-fuel ratio correction amount by a first skip amount during a predetermined time period after the result of the comparison of said upstream-side air-fuel ratio sensor is changed;

means for shifting said air-fuel ratio correction amount of a second skip amount smaller than said first skip amount after said predetermined time period has passed;

means for comparing the output of said downstream-side air-fuel ratio with a second predetermined value;

means for caalculating an air-fuel ratio feedback control parameter in accordance with the result of the comparison of the output of said downstream-side air-fuel ratio sensor with said second predetermined value; and means for adjusting the actual air-fuel ratio in accordance with said air-fuel ratio correction amount and said air-fuel ratio feedback control parameter;

wherein said gradually-changing means comprises:

means for gradually decreasing said air-fuel ratio correction amount when the output of said upstream-side air-fuel sensor is on the rich side with respect to said first predetermined value; and means for gradually increasing said air-fuel ratio correction amount when the output of said upstream-side air-fuel sensor is on the lean side with respect to said first predetermined value; and wherein said shifting means by said first skip amount comprises:

means for shifting down said air-fuel ratio correction amount by said first skip amount for said predetermined time period after the result of the comparison of said upstream-side air-fuel ratio sensor is switched from the lean side to the rich side; and means for shifting up said air-fuel ratio correction amount by said first skip amount for said predetermined time period after the result of the comparison of said upstream-side air-fuel ratio sensor is switched from the rich side to the lean side; and wherein said skipping means by said second skip amount comprises:

means for shifting up said air-fuel ratio correction amount by said second skip amount after said predetermined time period has passed after the result of the comparison of said upstream-side air-fuel ratio sensor is switched from the lean side to the rich side; and means for shifting down said air-fuel ratio correction amount by said second skip amount after said predetermined time period has passed after the result of the comparison of said upstream-side air-fuel ratio sensor is switched from the rich side to the lean side.

34. An apparatus as set forth in claim 33, wherein said predetermined time period is determined by the speed of said engine.

35. An apparatus as set forth in claim 33, wherein said second skip amount during said shifting down means is different from said second skip amount during said shifting up means.

36. An apparatus as set forth in claim 33, wherein said air-fuel ratio feedback control parameter is determined by a rich delay time period for delaying the result of the comparison of said upstream-side air-fuel ratio sensor switched from the lean side to the rich side and a lean delay time period for delaying the result of the comparison of said upstream-side air-fuel ratio sensor switched from the rich side to the lean side.

37. An apparatus as set forth in claim 36, wherein said air-fuel ratio feedback control parameter calculating means comprises:

means for increasing said lean delay time period when the output of said downstream-side air-fuel ratio sensor is on the rich side with respect to said second predetermined value; and means for decreasing said lean delay time period when the output of said downstream-side air-fuel ratio sensor is on the lean side with respect to said second predetermined value.

38. An apparatus as set forth in claim 36, wherein said air-fuel ratio feedback control parameter calculating means comprises:

means for decreasing said rich delay time period when the output of said downstream-side air-fuel ratio sensor is on the rich side with respect to said second predetermined value; and means for increasing said rich delay time period when the output of said downstream-side air-fuel ratio sensor is on the lean side with respect to said second predetermined value.

39. An apparatus as set forth in claim 36, wherein said air-fuel ratio feedback control parameter calculating means comprises:

means for increasing said lean delay time period and decreasing said rich delay time period when the output of said downstream-side air-fuel ratio sensor is on the rich side with respect to said second predetermined value; and means for decreasing said lean delay time period and increasing said rich delay time period when the output of said downstream-side air-fuel ratio sensor is on the lean side with respect to said second predetermined value.

40. An apparatus as set forth in claim 33, wherein said air-fuel ratio feedback control parameter is determined by said first skip amount (lean skip amount) during said shifting-down step and said first skip amount (rich skip amount) during said shifting-up step.

41. An apparatus as set forth in claim 40, wherein said air-fuel ratio feedback control parameter calculating means comprises:

means for increasing said first skip amount (lean skip amount) of said shifting-down means when the output of said downstream-side air-fuel ratio sensor is on the rich side with respect to said second predetermined value; and decreasing said first skip amount (lean skip amount) of said shifting-down means when the output of said downstream-side air-fuel ratio sensor is on the lean side with respect to said second predetermined value.

42. An apparatus as set forth in claim 40, wherein said air-fuel ratio feedback control parameter calculating means comprises:

means for decreasing said first skip amount (rich skip amount) of said shifting-up means when the output of said downstream-side air-fuel ratio sensor is on the rich side with respect to said second predetermined value; and means for increasing said first skip amount (rich skip amount) of said shifting-up means when the output of said downstream-side air-fuel ratio sensor is on the lean side with respect to said second predetermined value.

43. An apparatus as set forth in claim 40, wherein said air-fuel ratio feedback control parameter calculating means comprises:

means for increasing said first skip amount (lean skip amount) of said shifting-down means and decreasing said first skip amount (rich skip amount) during said shifting-up step when the output of said downstream-side air-fuel ratio sensor is on the rich side with respect to said second predetermined value; and means for decreasing said first skip amount (lean skip amount) of said shifting-down means and increasing said first skip amount (rich skip amount) during said shifting-up means when the output of said downstream-side air-fuel ratio sensor is on the lean side with respect to said second predetermined value.

44. An apparatus as set forth in claim 33, wherein said air-fuel ratio feedback control parameter is determined by the decreasing speed of said gradually-decreasing means and the increasing speed of said gradually-increasing means.

45. An apparatus as set forth in claim 44, wherein said air-fuel ratio feedback control parameter calculating means comprises:

means for increasing the decreasing speed of said gradually-decreasing means when the output of said downstream-side air-fuel ratio sensor is on the rich side with respect to said second predetermined value; and means for decreasing the decreasing speed of said gradually-decreasing means when the output of said downstream-side air-fuel ratio sensor is on the lean side with respect to said second predetermined value.

46. An apparatus as set forth in claim 44, wherein said air-fuel ratio feedback control parameter calculating means comprises:

means for decreasing the increasing speed of said gradually-increasing means when the output of said downstream-side air-fuel ratio sensor is on the rich side with respect to said second predetermined value; and means for increasing the increasing speed of said gradually-increasing means when the output of said downstream-side air-fuel ratio sensor is on the lean side with respect to said second predetermined value.

47. An apparatus as set forth in claim 44, wherein said air-fuel ratio feedback control parameter calculating means comprises:

means for increasing the decreasing speed of said gradually-decreasing means and decreasing the increasing speed of said gradually-increasing means when the output of said downstream-side air-fuel ratio sensor is on the rich side with respect to said second predetermined value; and means for decreasing the decreasing speed of said gradually-decreasing means and increasing the increasing speed of said gradually-increasing means when the output of said downstream-side air-fuel ratio sensor is on the lean side with respect to said second predetermined value.

48. An apparatus as set forth in claim 33, wherein said air-fuel ratio feedback control parameter is determined by said first predetermined value.

49. An apparatus as set forth in claim 48, wherein said air-fuel ratio feedback control parameter calculating means comprises:

means for decreasing said first predetermined value in the case where said air-fuel ratio sensors are $O_2$ sensors, when the output of said downstream-side air-fuel ratio sensor is on the rich side with respect to said second predetermined value; and means for increasing said first predetermined value in the case where said air-fuel ratio sensors are $O_2$ sensors, when the output of said downstream-side air-fuel ratio sensor is on the lean side with respect to said second predetermined value.

50. An apparatus as set forth in claim 33, further comprising means for delaying the result of the comparison of said downstream-side air-fuel ratio sensor with said second predetermined value.

* * * * *